United States Patent [19]

Seidler et al.

[11] Patent Number: 4,586,519

[45] Date of Patent: May 6, 1986

[54] COMPACT CASE

[75] Inventor: David Seidler, Forest Hills, N.Y.; Harley H. Mattheis, Verona, N.J.

[73] Assignee: Risdon Corporation, Naugatuck, Conn.

[21] Appl. No.: 663,566

[22] Filed: Oct. 22, 1984

[51] Int. Cl.[4] ..... A45D 33/00

[52] U.S. Cl. ..... 132/83 R

[58] Field of Search ..... 132/82 R, 83, 73

[56] References Cited

U.S. PATENT DOCUMENTS

| | | | |
|---|---|---|---|
| 2,141,328 | 12/1938 | Younghusband | 132/82 R |
| 2,737,189 | 3/1956 | Morningstar et al. | 132/83 R |
| 2,763,271 | 9/1956 | Nelson | 132/82 R |
| 4,454,889 | 6/1984 | Contreras | 132/82 R |

*Primary Examiner*—Gregory E. McNeill

*Attorney, Agent, or Firm*—St.Onge Steward Johnston & Reens

[57] ABSTRACT

A compact case for sealingly supporting and enclosing a cosmetic preparation. A receptacle for the cosmetic preparation is mounted on a lower cover by means of a flexible annular member which permits relative movement between the receptacle and the lower cover in both axial and radial direction. The receptacle includes a platform and a first annular rim which projects from the platform. An upper cover hinged to a lower cover for movement between open and closed positions includes a second annular rim fittingly engageable with the first annular rim when the upper cover is moved to the closed position. The receptacle has a flexible annular member of "V" or "U" shaped cross section around it to permit movement of the receptacle in vertical and horizontal directions. This movement accommodates the mating closure rim and assures that an effective circumferential seal is always obtained between the annular rims. In some instances, the mating surfaces of the annular rims may be tapered, or one or the other of the rims may be hollowed out to form a "V"-shaped cross section. The annular members may also be made of dissimilar materials.

18 Claims, 8 Drawing Figures

COMPACT CASE

BACKGROUND OF THE INVENTION

The present invention relates to improvements in compact cases for cosmetic preparations and, particularly, to a new and improved compact case providing an airtight seal to prevent product dryout and seepage.

Compact cases have long been used for enclosing various cosmetic preparations such as powder, rouge, blushers, facial creams, and the like. Such cases are generally small portable containers designed to fit in a woman's pocketbook or purse. A problem with such compact cases has been their general inability to prevent dryout, caking, or seepage of the cosmetic preparation. The problem is exemplified by the patents to Fullmer U.S. Pat. No. 1,912,187 to Sandberg U.S. Pat. No. 2,054,004 to Leitner U.S. Pat. No. 2,410,585 and to Grassi U.S. Pat. No. 2,424,817. Each of these patents discloses a construction which attempts to avoid the above problems. Fullmer discloses a ring of cork, felt, or other compressible material to provide a seal and prevent the spilling of powder when the compact is closed. Sandberg discloses springs to hold an upper edge of the powder receptacle against an inner cover when an outer cover was closed. Leitner discloses a toroidal compressible gasket or sealing ring, permanently seated in a circular groove to be compressed to form a more positive seal when the two casing members are fully closed. Grassi discloses a pair of rings which have mutually engageable metallic beads on them. When the Grassi case is closed, the smaller convex bead of one ring loosely enters the concave bead of another ring, to form a seal at this zone and thus seal powder in the case.

More recent prior art is Kingsford U.S. Pat. No. 3,911,936, issued Oct. 14, 1975. According to that patent, the compact case is composed of resilient plastic, injection-molded elements. The patent states that the dies may be so accurately constructed as to provide inner and outer seals utilizing the resiliency of the parts alone.

Prior art patents relating to closures are the following: Marchant, U.S. Pat. No. 3,252,492, discloses a plastic bottle with a captive snap-on cap. Dahl, U.S. Pat. No. 4,060,173, discloses a container formed of a flexible sheet of resilient thermoplastic resin having a body section and a cover section which are hinged together, each having side and end walls which telescope together when closed. Davis, U.S. Pat. No. 4,298,133, discloses a foam plastic disposable tray and cover typically used for take-out dinners which are joined by an integral hinge along one edge. Tabs and undercut tab seats are formed in the tray and cover distant from the hinge to releasably latch the cover in a closed position on the tray.

Patents relating to hinge constructions are Dearth, U.S. Pat. No. 3,616,487; Wiesinger, U.S. Pat. No. 4,403,712; and Reuter, U.S. Pat. No. 4,407,427. The Dearth and Wiesinger patents both disclose flexible hinges of undulating or deformable rib constructions, while the patent to Reuter discloses a hinged construction where the cover of a waste container comprises a plurality of generally parallel ridges and grooves.

SUMMARY OF THE INVENTION

The compact case disclosed sealingly supports and encloses a cosmetic preparation by providing a self-adjusting seal assembly. A receptacle for the cosmetic preparation is mounted on a lower cover by means of a flexible annular member which permits relative movement between the receptacle and the lower cover in both axial and radial directions. The receptacle includes a platform and an annular rim which projects outwardly from the platform. An upper cover hinged to the lower cover for movement between open and closed positions includes a second annular rim fittingly engageable with the first annular rim when the upper cover is moved to the closed position. The floating nature of the receptacle assures that an effective circumferential seal is always obtained between the annular rims. In some instances, the flexible annular member may have a "V"-shaped cross section and, in other instances, a "U"-shaped cross section. In some embodiments the mating surfaces of the annular rims may be tapered, or one or the other of the rims may be hollowed out to form a "U"-shaped cross section. The annular members may also be made of dissimilar materials.

The "floating platform" of the invention allows for a tight seal to be attained within the range of commercial tolerances which are inherent in the manufacture of a compact case. Since there may be initial uneven contact of the engaging surfaces, the "floating platform" construction also accommodates such misalignment. Further, when the compact case is closed, the platform may be angularly disposed relative to the upper and lower covers, yet, the "floating platform" construction will still afford a seal.

Other and further features, objects, advantages, and benefits of the invention will become apparent from the following description taken in conjunction with the following drawings. It is to be understood that both the foregoing general description and the following detailed description are exemplary and explanatory but are not restrictive of the invention. The accompanying drawings which are incorporated in and constitute a part of this invention, illustrate the several embodiments of the invention and, together with the description, serve to explain the principles of the invention.

DETAILED DESCRIPTION OF THE DRAWINGS

DESCRIPTION OF THE PREFERRED EMBODIMENTS

As will be disclosed in detail below, a primary feature of the invention resides in the construction of the receptacle for the cosmetic preparation which is mounted in such a manner that it can be said to be "free floating", that is, free to move a finite distance in both axial and radial directions. The receptacle itself includes an outwardly projecting annular rim and a mating member similarly includes an annular rim engageable with that on the receptacle when the case is closed. The sealing or mating surfaces of the rim on the receptacle are automatically accommodated through those of its mating member whereby an effective seal is assured notwithstanding molding inaccuracies. The configurations disclosed below show embodiments of the invention and the sealing of the receptacle.

Figure 1:
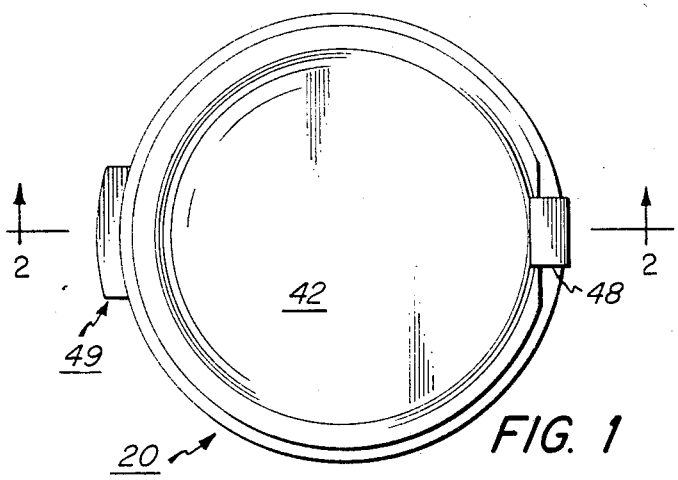
FIG. 1 is a top plan view of a compact case which embodies the principles of the present invention.
Figure 2:
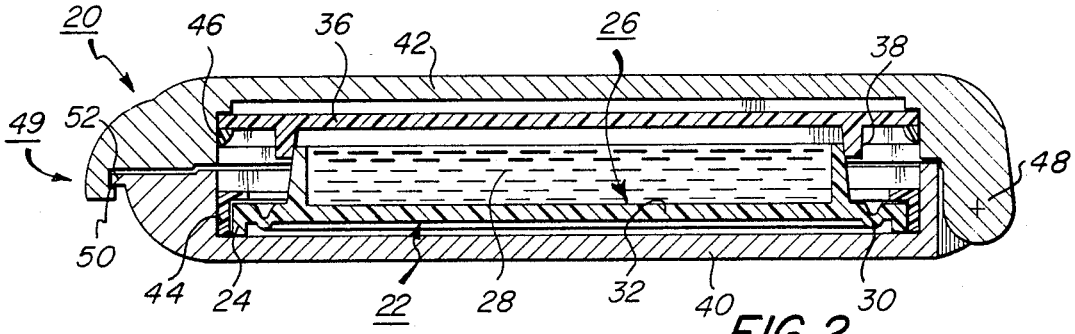
FIG. 2 is a cross-sectioned view taken generally along line 2—2 in FIG. 1.

Referring now to FIGS. 1 and 2, a compact case 20 is provided with a lower base 22 which includes an outer support member 24, a receptacle 26 for containing a cosmetic preparation 28, and an annular connecting member 30 flexibly mounting the receptacle 26 and the support member 24.

Figure 3:
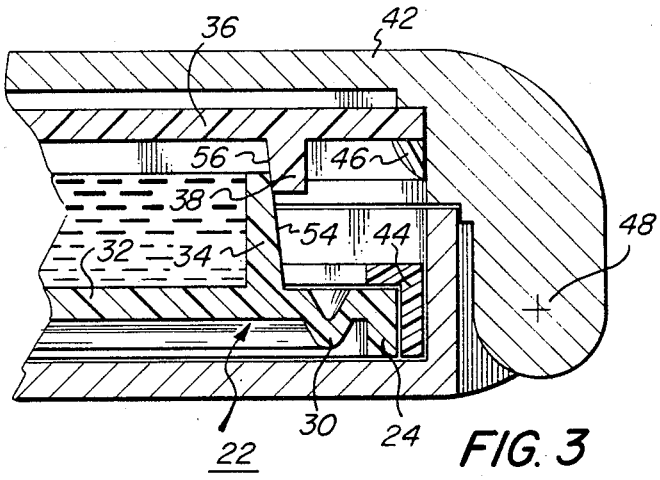
FIG. 3 is a detailed cross-sectioned view illustrating a portion of FIG. 2.

The outer support member 24, the receptacle 26, and the connecting member 30 are all integral, and the connecting member is thinner than either the outer support member or the receptacle. The connecting member 30 may be made discontinuous around the periphery of the receptacle, or may be made so that it is more resilient than either the receptacle or the support member. As more fully seen in FIG. 3, the connecting member 30 is preferably formed so as to have a substantially "V"-shaped cross-section. The connecting member, by being thinner, provides the receptacle with freedom of motion relative to the outer support member. The V-shape is effective in permitting relative movement between the receptacle 26 and the outer support member 24 both in the axial and radial direction. As seen in FIG. 3, axial means motion up or down and radial means motion to the left or right.

As seen in FIG. 3, the receptacle 26 includes a platform 32 for the cosmetic preparation and a first annular rim 34 which is integral with the platform and projects upwardly from the platform to form a cosmetic container.

The compact case 20 also includes an upper base 36 which is movable to an open position, not shown. The upper base 36 includes a second annular rim 38 which projects downwardly from the upper base and is engageable with rim 34 when the upper base 36 is closed. When closed, the floating nature of the receptacle 26 with its flexible connecting member 30 assures an effective circumferential seal between the first and second rims.

As shown in FIGS. 1 and 2, the compact case 20 includes a lower cover 40 for supporting the lower base 22 and an upper cover 42 for supporting the upper base 36. A retainer ring 44 suitably engages the outer support member 24 and holds it and the lower base 22 fixed to the lower cover 40, without restricting the floating action of the receptacle 26. In a similar fashion, a retainer ring 46 serves to hold the upper base 36 relative to the upper cover 42. A hinge 48 pivotally connects the upper and lower covers and enables them to move between the open position and the closed position.

As shown in FIGS. 1 and 2, the compact case 20 is provided with a mutually engageable latch mechanism 49 at locations on the covers 40 and 42 which are opposite the hinge 48. The latch mechanism 49 includes a notch 50 in the upper cover 42 which engages with a projection 52 on the lower cover 40. The covers 40 and 42 are formed of resilient material so that the notch 50 can readily be moved out of engagement with the projection 52 when the compact is opened.

As shown in FIG. 3 the annular rim 34 has an outer surface 54 which is inclined inwardly, toward the center of the compact. In a similar fashion, the annular rim 38 has an inner surface 56 which is inclined outwardly, away from the center of the compact case. The surfaces 54 and 56, as clearly seen in FIG. 3, are mutually engageable in an interference fit when the upper base is in the closed position. The rims 34 and 38 will be self-centered upon closure of the upper cover 42 onto the lower cover 40, because of the resilient connecting member 30. Receptacle 26 can thus move horizontally as well as vertically, thereby ensuring good sealing of the cosmetic preparation 28 within the receptacle. The cover 42 can also cam the receptacle 26 downwardly as the cover is closed so that a good circumferential seal is obtained between the respective tapered surfaces 54 and 56. In order to assure an optimum sealing relationship between the surfaces 54 and 56, it is preferred that the angles of inclination of those surfaces be substantially the same.

Figure 4:
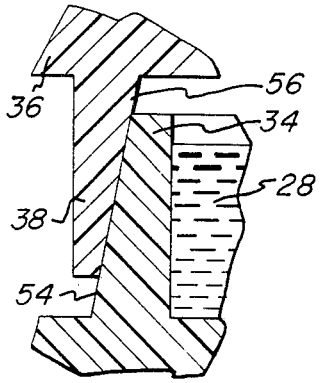
FIG. 4 is an enlarged cross-sectioned view illustrating a second embodiment of the invention.

FIG. 4 is illustrative of another embodiment of the present invention in which the second annular rim 38 extends downward further relative to the first annular rim 34.

Figure 5:
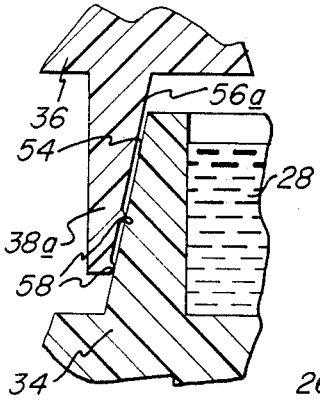
FIG. 5 is a cross-sectioned view, similar to FIG. 4, illustrating another embodiment of the invention.

Referring now to the embodiment shown in FIG. 5, a slightly modified second annular rim **38*a*, having surface 56*a* is provided with a pair of bead seals 58 for engaging the surface 54 of the first annular rim 34. The bead seals 58 are preferably molded integrally with the surface 56*a* and provide a continuing circumferential closure between the rim 34 and the rim 38*a***.

Figure 6:
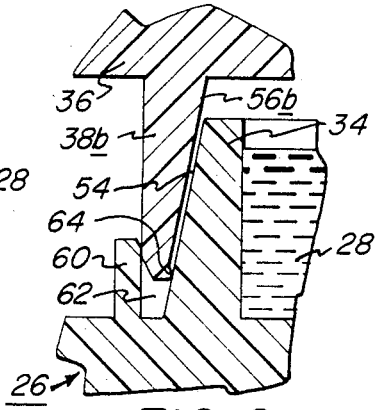
FIG. 6 is a cross-sectioned view, similar to FIGS. 4 and 5, illustrating another embodiment of the invention.

Referring now to the embodiment shown in FIG. 6, the receptacle 26 is provided with a third annular rim 60 coaxial with the rim 34 but positioned at a greater radial distance from the center of the case 20. An annular space 62 is thereby defined between the rims 34 and 60 and serves to receive a modified version of the rim **38*b*. The width of the space 62 assures a snug fit among the three rims. The seal can be further enhanced by a bead seal 64 formed on a surface 56*b* of the rim 38*b* for engagement with the surface 54**.

Figure 7:
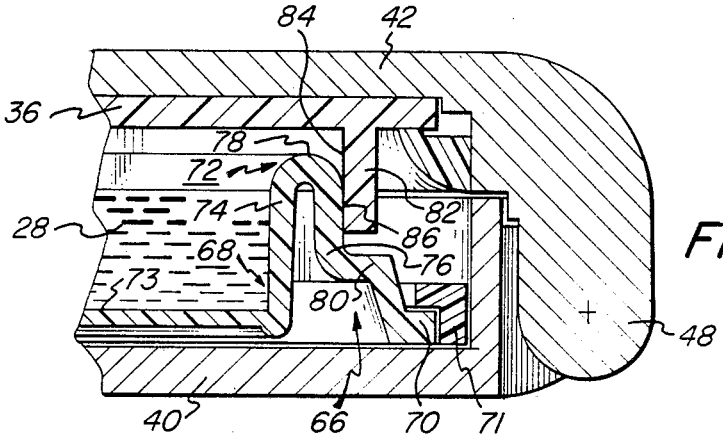
FIG. 7 is a detailed cross-sectioned view, similar to FIG. 3, illustrating another embodiment of the invention.

Referring now to the embodiment shown in FIG. 7, a connecting member 66, integral with a receptacle 68 and with an outer support member 70, permits the receptacle to move both axially and radially relative to the support member generally in the manner of the embodiments already described. Also, in a manner similar to that described with respect to the above embodiments, a suitable retainer ring 71 engages the outer support member 70 to hold the lower base in position in the lower cover 40. The connecting member 66 includes a modified first annular rim 72 having an inverted, substantially U-shaped cross section. As illustrated in FIG. 7, the receptacle 68 includes a horizontal platform 73. The rim 72 includes an inner leg 74 and an outer leg 76, the legs 74 and 76 being generally parallel to one another and joined at their upper ends by a curved bight 78. The base of the outer leg 76 is joined to the outer support member 70 by means of a horizontal element 80.

A modified second annular rim 82 includes an inner sealing surface 84 which is engageable in an interference fit with an outer sealing surface 86 on the outer leg 76 when the upper base 36 is in the closed position.

By reason of the construction illustrated in FIG. 7, the receptacle 68 is enabled to move both axially and radially with respect to the lower cover 40. The interference fit of the annular rims 72 and 82 is such that, upon opening and closing, a rolling action occurs because of the bellows design which is the inverted U-shaped cross-section of the rim 72. As the upper base 36 closes upon the lower base 22, and the inner sealing surface 84 engages the outer sealing surface 86, deformation of the rim 72 is caused in the region of engagement. As closure continues, the deformation is uniformly imparted to the rim 72 but with decreasing deformation for a distance along the circumference of the rim 72 as ever greater portions of the inner and outer sealing surfaces come into engagement. When the upper base 36 is finally closed, the receptacle 68 will have yieldably moved in vertical and horizontal directions to accommodate the upper base. The rim 72 is deformed by the rim 82 around its entire circumference, with the rim 72 collapsing onto itself allowing the interference to be minimized until there is complete engagement of the rims 72 and 82. Once closed, the bellows fold is relaxed to allow the surfaces 84 and 86 at their seal points to equalize contact point pressure.

Figure 8:
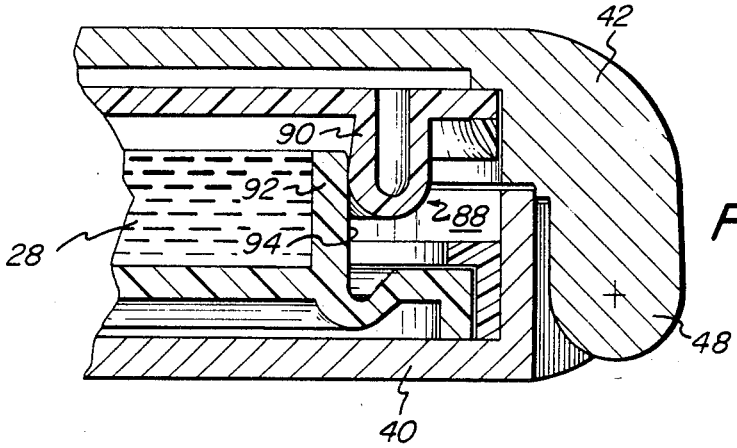
FIG. 8 is another detailed cross-sectioned view similar to FIG. 3, illustrating yet another embodiment of the invention.

Referring now to FIG. 8, a modified second annular rim 88 is of a U-shaped cross section and is provided with an inner surface 90. A modified first annular rim 92 mounted on the lower cover 40 has an outer surface 94, the outer and inner surfaces being mutually engageable in an interference fit when the cover 42 is in the closed position. Thus, as with the construction of the rim 72, the rim 88 also is flexible enabling it to collapse during closure. The receptacle of which the rim 92 is an integral element, is movable axially and radially to assure that the closure between the rims 88 and 92 will seal in the cosmetic preparation.

While the lower base with the "floating" platform and the upper base with its sealing rim in the above embodiment are shown as separate elements, it should be understood that these components may be made integral with their associated cover.

The invention, and its broader aspects, is not limited to the specific details shown and described; rather, departures may be made from such details without departing from the principles of the invention.

What is claimed is:

1. A compact case for sealingly supporting and enclosing a cosmetic preparation comprising:

a lower base including an outer support member, a receptacle for containing the cosmetic preparation, and an annular connecting member flexibly mounting said receptacle to said support member permitting relative movement between said receptacle and said support member in both axial and radial directions, said receptacle including a platform and a first annular rim projecting from said platform, and an upper base movable between an open position spaced from said lower base and a closed position adjacent said lower base, said upper base including a second annular rim projecting therefrom circumferentially engageable with said first annular rim when said upper base is in the closed position, whereby said flexible connecting member provides self adjusting movement between said first and second rims to effectively seal the cosmetic preparation from the environment.

2. A compact case as set forth in claim 1 including a lower cover for receiving and supporting said lower base therein, and including an upper cover for receiving and supporting said upper base therein, said upper and lower covers being hinged for movement between the open position at which said upper base is spaced from said lower base and the closed position at which said first and second rims are in mutual engagement, said upper and lower bases being enclosed by said upper and lower covers.

3. A compact case as set forth in claim 2, said upper and lower covers are integrally formed with their respective upper and lower bases.

4. A compact case as set forth in claim 1 wherein said first annular rim includes an outer surface which is inclined to reduce its circumference and wherein said second annular rim includes an inner surface which is inclined to increase its circumference away from said upper base, said outer and inner surfaces being mutually engageable in an interference fit when said upper base is in the closed position.

5. A compact case as set forth in claim 4 wherein the angles of inclination of said inner and outer surfaces are substantially the same.

6. A compact case as set forth in claim 1 wherein said outer support member, said receptacle, and said connecting member are integral, said connecting member being flexible relative to said outer support member and said receptacle.

7. A compact case as set forth in claim 6 wherein at least part of said connecting member has a substantially "V"-shaped cross section.

8. A compact case as set forth in claim 1 wherein said second annular rim includes a circumferential bead seal on said inner surface for engagement with said outer surface.

9. A compact case as set forth in claim 1 wherein a third annular rim is provided on said platform coaxial with said first annular rim, said first and third annular rims defining an annular space therebetween adapted to receive said second annular rim in a close fitting relationship.

10. A compact case as set forth in claim 6 wherein said first annular rim has an inverted substantially U-shaped cross section and an outer surface and wherein said second annular rim includes an inner surface, said outer and inner surfaces being mutually engageable in an interference fit when said upper base is in the closed position.

11. A compact case as set forth in claim 9, wherein said first annular rim is composed of a material dissimilar from that of said second annular rim.

12. A compact case as set forth in claim 9 wherein said first annular rim is composed of a more resilient material than that of said second annular rim.

13. A compact case as set forth in claim 6 wherein said second annular rim has a U-shaped cross section and an inner surface and wherein said first annular rim includes an outer surface, said outer and inner surfaces being mutually engageable in an interference fit when said upper base is in the closed position.

14. A compact case for sealingly supporting and enclosing a cosmetic preparation comprising:

a lower base including an annular support member, a circular receptacle for containing a cosmetic preparation, and an annular resilient connecting member integral with said support member and said receptacle for supporting said receptacle on said base member while permitting both radial and axial movement thereof; and an upper base including an annular rim movable between an open position distant from said lower base and a closed position proximate to said lower base, said rim being sealingly engaged with said connecting member in the closed position for isolating the cosmetic preparation in the receptacle from the environment.

15. A compact case as set forth in claim 14 including a hinge pivotally connecting said upper base and said lower base for controlled movement of said upper base between open and closed positions, said receptacle and said annular rim of said upper base being coaxial and said hinge means being spaced from said upper base annular rim in a direction away from said axes.

16. A compact case as set forth in claim 14:

wherein said receptacle lies generally in a horizontal plane;

wherein said connecting member includes an inverted U-shaped rim extending upwardly having inner and outer legs and a rounded bight flexibly connecting said legs, said outer leg having an outer sealing surface, said connecting member further including a generally horizontal element flexibly connecting said outer leg with said support member and permitting axial movement of said receptacle relative to said support member; and wherein said upper base annular rim extends downwardly in the closed position and has an inner sealing surface engageable with said outer sealing surface when said upper base is moved to the closed position, said outer leg being radially moveable relative to said inner leg and said horizontal element being yieldably moveable axially such that said receptacle can accommodate said upper base annular rim when said upper base is closed thereby effectively isolating the cosmetic preparation from the environment.

17. A compact for sealing a cosmetic preparation from the environment, comprising:

an upper base;

a lower base;

hinge means pivotally connecting said upper base to said lower base for relative movement thereof between an open position and a closed position;

a receptacle including a platform for containing the cosmetic preparation;

a first annular rim resiliently mounting said receptacle on said lower base permitting movement of said receptacle relative to said base in the plane of said platform and in directions transverse to the plane of said platform;

a second annular rim mounted on said upper base sealingly engageable with said first annular rim when said upper base and said lower base are in the closed position for effectively isolating the cosmetic preparation from the environment.

18. A compact as set forth in claim 17:

wherein said first and second rims are substantially coaxial when they are in the closed position;

wherein said second annular rim is relatively rigid and has a continuous inner sealing surface;

wherein said first annular rim has a continuous outer sealing surface; and wherein said hinge means is spaced from said first and second rims in a direction away from their said axes such that as said upper base is moved from the open position to the closed position, initially, a portion of said inner sealing surface engages a portion of said outer sealing surface causing deformation of said first annular rim in the region of engagement of said inner and outer sealing surfaces and, as closure continues, the deformation is uniformly imparted to said first annular rim but with decreasing deformation along the circumference of said first annular rim as ever greater portions of said inner and outer sealing surfaces come into engagement until, with said upper base in the closed position, said receptacle having yieldably moved in the plane of said platform and in directions transverse thereto to accommodate said upper base, a sealing deformation is imparted to said first annular rim around its circumference as it engages said second annular rim.

* * * * *